US012285113B2

(12) United States Patent
Chen

(10) Patent No.: US 12,285,113 B2
(45) Date of Patent: Apr. 29, 2025

(54) DUAL USE DEVICE FURNITURE COMPONENT AND FURNITURE COVER

(71) Applicant: Foremost Home Inc., East Hanover, NJ (US)

(72) Inventor: Liang Chou Chen, Taipei (TW)

(73) Assignee: Foremost Homes Inc., East Hanover, NJ (US)

( * ) Notice: Subject to any disclaimer, the term of this patent is extended or adjusted under 35 U.S.C. 154(b) by 194 days.

(21) Appl. No.: 18/182,129

(22) Filed: Mar. 10, 2023

(65) Prior Publication Data

US 2023/0284794 A1 Sep. 14, 2023

Related U.S. Application Data

(63) Continuation-in-part of application No. 17/859,246, filed on Jul. 7, 2022, now abandoned.

(30) Foreign Application Priority Data

Mar. 10, 2022 (CN) ..... 202220524626.2

(51) Int. Cl.
*A47C 7/66* (2006.01)
*A47C 7/42* (2006.01)
*A47C 31/11* (2006.01)

(52) U.S. Cl.
CPC ..... *A47C 31/11* (2013.01); *A47C 7/42* (2013.01)

(58) Field of Classification Search
CPC ..... A47C 31/10; A47C 31/11; A47C 31/113
See application file for complete search history.

(56) References Cited

U.S. PATENT DOCUMENTS 2,183,418 A * 12/1939 Williams ..... A47G 9/1045 5/636
3,228,034 A * 1/1966 Grove ..... A41D 15/04 5/413 R (Continued)

FOREIGN PATENT DOCUMENTS

DE 20011387 U1 9/2000
WO 2022183234 A1 9/2022

OTHER PUBLICATIONS

Extended European Search Report for corresponding European Application No. 23157102; dated Jul. 17, 2023; 5 pages.

(Continued)

*Primary Examiner* — Shin H Kim
(74) *Attorney, Agent, or Firm* — Faegre Drinker Biddle & Reath LLP

(57) ABSTRACT

A dual use device adapted to define a furniture component when in a stored state and provide access to a cover for covering a furniture item when in a covering state. The device includes an enclosure with a plurality of enclosure panels, the enclosure panels being connected as to define a shape of the furniture component. The connection between at least some of the enclosure panels is through detachable attachments which permit access to an internal space within the enclosure. A cover for covering a furniture item is foldably received within the internal space when the dual use device is in its stored state and the dual use device serves as a furniture component. The cover adapted to be extracted from the internal space and unfolded to cover the furniture item when the dual use device is in its covering state.

14 Claims, 15 Drawing Sheets

(56) References Cited

U.S. PATENT DOCUMENTS

| | | | | |
|---|---|---|---|---|
| 5,938,336 | A | 8/1999 | King | |
| 6,275,993 | B1 | 8/2001 | McCarley | |
| 6,367,083 | B1 | 4/2002 | November | |
| 6,493,891 | B1 | 12/2002 | Livingston | |
| 6,969,119 | B1 * | 11/2005 | Jennings | A47C 16/02 297/219.1 |
| D529,745 | S | 10/2006 | Eskandry | |
| 8,464,374 | B1 | 6/2013 | Thayer | |
| 9,681,764 | B1 | 6/2017 | Boynton | |
| D833,109 | S | 11/2018 | Hoffman | |
| 10,231,560 | B2 * | 3/2019 | Carlile | A47G 9/062 |
| D901,939 | S | 11/2020 | Liu | |
| D903,378 | S | 12/2020 | Johnston | |
| 10,856,663 | B2 * | 12/2020 | Bowen | A47C 31/113 |
| 10,856,669 | B2 * | 12/2020 | Lin | A47C 31/113 |
| 10,945,519 | B2 * | 3/2021 | Chacker | A41D 15/04 |
| D946,309 | S | 3/2022 | Wang | |
| 11,337,529 | B2 * | 5/2022 | Lin | A47C 31/113 |
| 11,583,102 | B2 * | 2/2023 | Lin | A47C 31/113 |
| D993,669 | S | 8/2023 | Wang | |
| 2007/0130693 | A1 | 6/2007 | Theriault | |
| 2010/0139001 | A1 | 6/2010 | Mangano | |
| 2013/0187415 | A1 | 7/2013 | Shelley | |
| 2015/0074912 | A1 | 3/2015 | Simon et al. | |
| 2017/0224138 | A1 | 8/2017 | Pelz et al. | |
| 2017/0303699 | A1 | 10/2017 | Howe | |
| 2018/0064269 | A1 | 3/2018 | Carlile | |
| 2018/0177312 | A1 | 6/2018 | Reed-Williams | |
| 2020/0046130 | A1 | 2/2020 | Bowen | |
| 2020/0154903 | A1 | 5/2020 | Lin et al. | |
| 2020/0329883 | A1 | 10/2020 | Jaikaransingh | |
| 2021/0085093 | A1 * | 3/2021 | Lin | A47C 31/113 |
| 2022/0240689 | A1 * | 8/2022 | Lin | A47C 31/113 |
| 2023/0029976 | A1 * | 2/2023 | Pelz | A47G 9/0223 |
| 2023/0137123 | A1 | 5/2023 | Loveland | |
| 2023/0148765 | A1 * | 5/2023 | Lin | A47C 31/113 297/229 |
| 2023/0284794 | A1 | 9/2023 | Chen | |
| 2024/0032698 | A1 * | 2/2024 | Wu | A47C 7/66 |

OTHER PUBLICATIONS

Office Action in related corresponding U.S. Appl. No. 17/859,246 dated Oct. 3, 2023, 14 pages.

* cited by examiner

DUAL USE DEVICE FURNITURE COMPONENT AND FURNITURE COVER

CROSS-REFERENCE TO RELATED APPLICATION

This application claims priority to and the benefit of Chinese Application No. 202220524626.2, filed on Mar. 10, 2022, and U.S. patent application Ser. No. 17/859,246, filed on Jul. 7, 2023, which are both incorporated herein by reference in their entirety and made part of this specification.

BACKGROUND

Technical Field

The disclosure relates to a dual use device applied to furniture and a furniture module including the dual use device.

Description of Related Art

Generally speaking, to protect furniture that is temporarily not in use, a user may cover the furniture with a bag. However, due to a relatively large size or unique shape of the furniture, it is difficult for a readily available bag to cover the furniture completely. Although a bag body as an original factory accessory can cover the furniture relatively well, it also needs to be specially reserved, and the storage location is also likely to be forgotten. Moreover, inconvenience may be caused since it is often necessary to rummage through containers when the bag body is to be used.

SUMMARY

The disclosure is directed to a furniture module and a dual use device. The dual use device may serve as a protective cover for furniture in one use state, and may serve as a throw pillow or a bolster pillow in the other use state. Therefore, the dual use device can provide different functions for the furniture under different use states, and can be used with the furniture without separate storage.

According to an embodiment of the disclosure, a dual use device is adapted to be used with furniture, and includes two covering elements and a cover body. The two covering elements are partially connected and are selectively closed together or opened. When the two covering elements are closed together, an internal space is formed between the two covering elements, the cover body is foldably received in the internal space, and the dual use device serves as a throw pillow or a bolster pillow. When the two covering elements are opened, the cover body is adapted to be unfolded and cover the furniture.

According to an embodiment of the disclosure, a furniture module includes furniture and a dual use device. The dual use device includes two covering elements and a cover body. The two covering elements are partially connected and are selectively closed together or opened. When the two covering elements are closed together, an internal space is formed between the two covering elements, the cover body is foldably received in the internal space, and the dual use device serves as a throw pillow or a bolster pillow. When the two covering elements are opened, the cover body is unfolded and covers the furniture.

In the dual use device according to an embodiment of the disclosure, the cover body is fixed to at least one of the two covering elements.

In the dual use device according to an embodiment of the disclosure, the two covering elements include a first connecting element and a second connecting element located at two boundaries and detachably fixed to each other. When the two covering elements are closed together, the first connecting element is fixed to the second connecting element to maintain a closed state of the two covering elements, and the cover body is stitched to a portion of the two covering elements close to the two boundaries when the two covering elements are unfolded.

In the dual use device according to an embodiment of the disclosure, the first connecting element and the second connecting element include a zipper set, a combination of a button and a buttonhole, snap and snap clasp, or a hook-and-loop fastener combination.

In the dual use device according to an embodiment of the disclosure, at least a part of the cover body includes an inner-layer structure and an outer-layer structure. The inner-layer structure is fixed to the at least one of the two covering elements.

In the dual use device according to an embodiment of the disclosure, the cover body includes two first portions, and a second portion and a third portion connected to the two first portions. The first portions cover a side surface of the furniture, the second portion covers a front surface of the furniture, and the third portion covers a rear surface of the furniture. The second portion is fixed to the at least one of the two covering elements.

In the dual use device according to an embodiment of the disclosure, the cover body includes an opening and a third connecting element close to the opening. When the cover body is unfolded and covers the furniture, the third connecting element is fixed to the furniture.

In the dual use device according to an embodiment of the disclosure, the third connecting element includes an elastic band, a binder, an attachment strip, hook and loop fastener, or a snap strip.

In the dual use device according to an embodiment of the disclosure, when the two covering elements are closed together, the dual use device is in a shape of a square, a rectangle, a circle, or an ellipse.

In the dual use device according to an embodiment of the disclosure, the furniture includes a chair, a table, ottoman, bench, chaise lounge or a bed.

In the dual use device according to an embodiment of the disclosure, an outline of the cover body after being unfolded corresponds to an outline of a portion of the furniture.

In the disclosure, the dual use device of the furniture module of the disclosure has two use states. When the two covering elements are closed together, the cover body is foldably received in the internal space, and the dual use device may serve as a throw pillow or a bolster pillow. When the two covering elements are opened, the cover body is adapted to be unfolded and cover the furniture, and may serve as a protective cover or a dust cover. If the cover body is not needed by the user to cover the furniture, the cover body may be received directly by the two covering elements without the additional need for looking for a bag. In addition, the dual use device after being received may also directly serve as a throw pillow or a bolster pillow and be used with the furniture to improve comfort of the user. If it is needed to cover the furniture, since the dual use device may be directly placed on the furniture, the dual use device may also be obtained directly and quickly without the need for rummaging through containers, and the overall design is convenient.

In another embodiment a dual use device is provides which is adapted to be used to cover a furniture item. The dual use device has a stored state and a covering state. The dual use device being in the form of a furniture component in its stored state. The dual use device includes an enclosure with a plurality of enclosure panels. The enclosure panels are connected so as to define a shape of the furniture component. The connection between at least some of the enclosure panels is preferably through one or more detachable attachments which permit the at least some enclosure elements to be separated from one another when the attachment is detached so as to provide an opening into an internal space within the enclosure.

A cover for covering a furniture item is foldably received within the internal space when the dual use device is in its stored state and the dual use device serves as a furniture component. The cover is adapted to be extracted from the internal space and unfolded to cover the furniture item when the dual use device is in its covering state.

In an embodiment, the cover is fixed to a portion of at least one of the enclosure panels on a surface within the internal space.

In an embodiment, the furniture component is ottoman, pouf, footrest or seat.

Optionally, the plurality of enclosure panels comprise a top panel, a plurality of sidewall panels attached to the top panel; and bottom panel attached to each of the sidewall panels. The detachable connections are between adjacent sidewall panels and between adjacent bottom panels.

Preferably the detachable connections are zippers and one zipper extends between adjacent sidewall panels and the corresponding adjacent bottom panels.

At least some of the enclosure panels may include an outer fabric layer attached to a stiffened structure positioned on an interior side of the enclosure panels, the stiffened structure providing support for the dual use device as a furniture component.

The stiffened structure may include a cushion layer and a stiffening layer that is structurally stiffer than the cushion layer.

The cushion layer may include at least one of polyester batting or down feathers, and the stiffening layer may include at least one of high density foam, low density foam, plastic, wood, or cardboard.

The cushioning layer may be attached to an inside surface of the outer fabric layer, and one side of the stiffening layer may be attached to the cushioning layer and the other side of the stiffening layer may be attached to a surface of the cover.

To make the aforementioned more comprehensible, several embodiments accompanied with drawings are described in detail as follows.

BRIEF DESCRIPTION OF THE DRAWINGS

The accompanying drawings are included to provide a further understanding of the disclosure, and are incorporated in and constitute a part of this specification. The drawings illustrate exemplary embodiments of the disclosure and, together with the description, serve to explain the principles of the disclosure.

DESCRIPTION OF THE EMBODIMENTS

Figure 1:
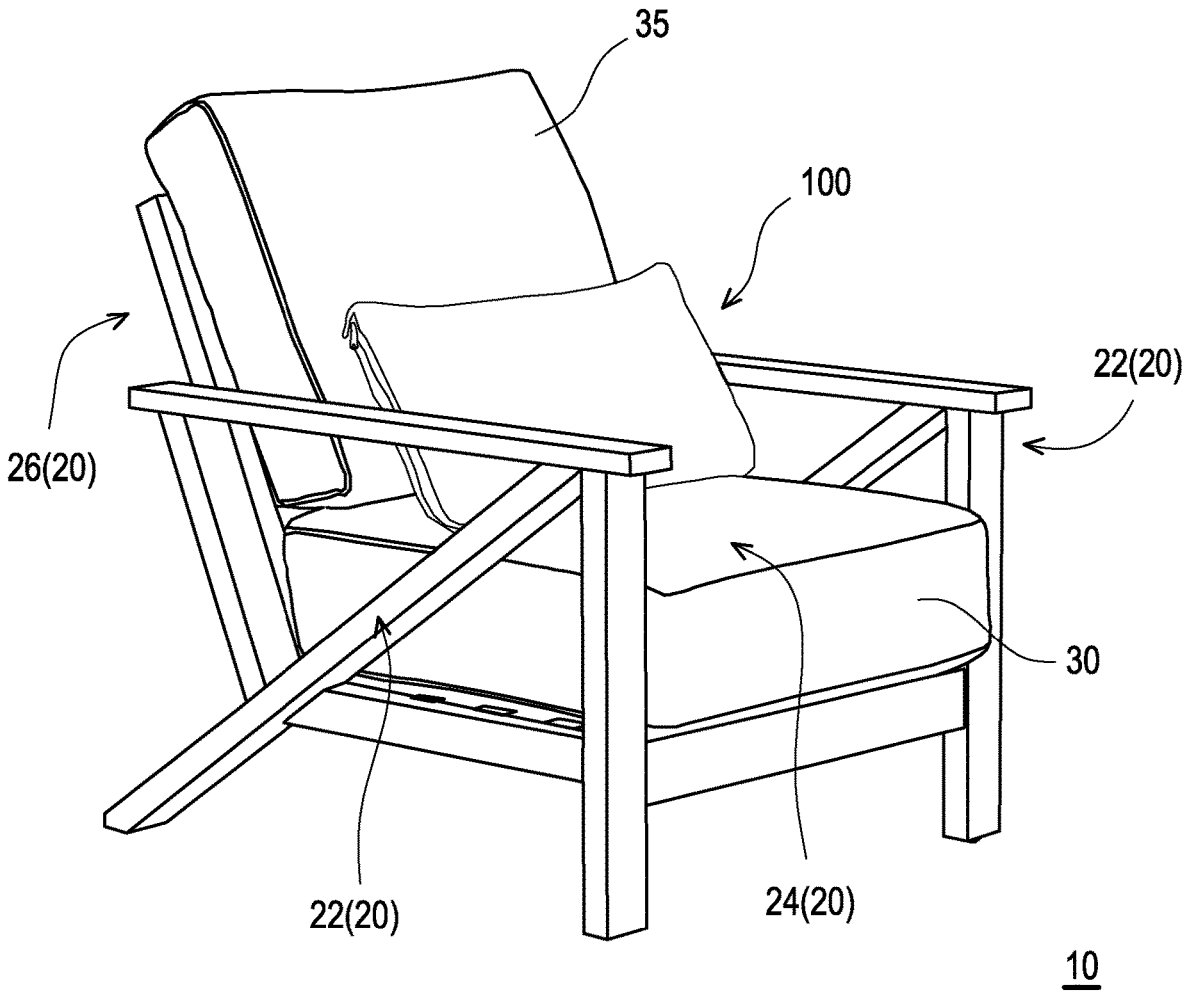
FIG. 1 is a schematic drawing showing a dual use device of a furniture module according to an embodiment of the disclosure in its stored state in the shape of a throw pillow.

Reference will now be made in detail to exemplary embodiments of the disclosure, examples of which are illustrated in the accompanying drawings. Wherever possible, the same reference numerals are used in the drawings and descriptions to refer to the same or similar parts.

FIG. 1 to FIG. 6 are schematic diagrams showing a dual use device of a furniture module according to an embodiment of the disclosure changing from a throw pillow state into a protective cover state. First, with reference to FIG. 1, a furniture module 10 includes furniture 20 and a dual use device 100. In this embodiment, the furniture 20 is a chair, for example. A single chair is taken as an example for the furniture 20 shown in FIG. 1, but the number of seats of the chair is not limited thereto. In other embodiments, the furniture may also be a chair with two seats, three seats, or four seats. In addition, in other embodiments, the furniture may also be a table, an ottoman, a chaise lounge, a bench or a bed. The table may be in a form of a coffee table, a side table, or the like, which is not limited. Dimensions of the bed, ottoman, chaise lounge or bench are not limited, either.

In this embodiment, a bottom cushion 30 and a back cushion 35 may be selectively provided on the furniture 20. In other embodiments, the bottom cushion 30 and the back cushion 35 may also be omitted. In addition, in this embodiment, the dual use device 100 in the collapsed or stored state may serve as a throw pillow a bolster pillow, a seat cushion or a back cushion, for example. In other embodiments, the throw pillow or the bolster pillow may also be presented with decorations such as dolls or other ornamentation, and the form is not limited.

FIG. 1 illustrates an embodiment where the dual use device 100 is placed on the furniture 20 in the form of a throw pillow or a bolster pillow, and may serve as a home accessory and/or improve comfort of the user when sitting down. The following is a step-by-step description of how the dual use device 100 is transformed into a protective cover or a dust cover for covering the furniture 20. In other words, the dual use device 100 serves two different functions for the furniture 20.

Figure 2:
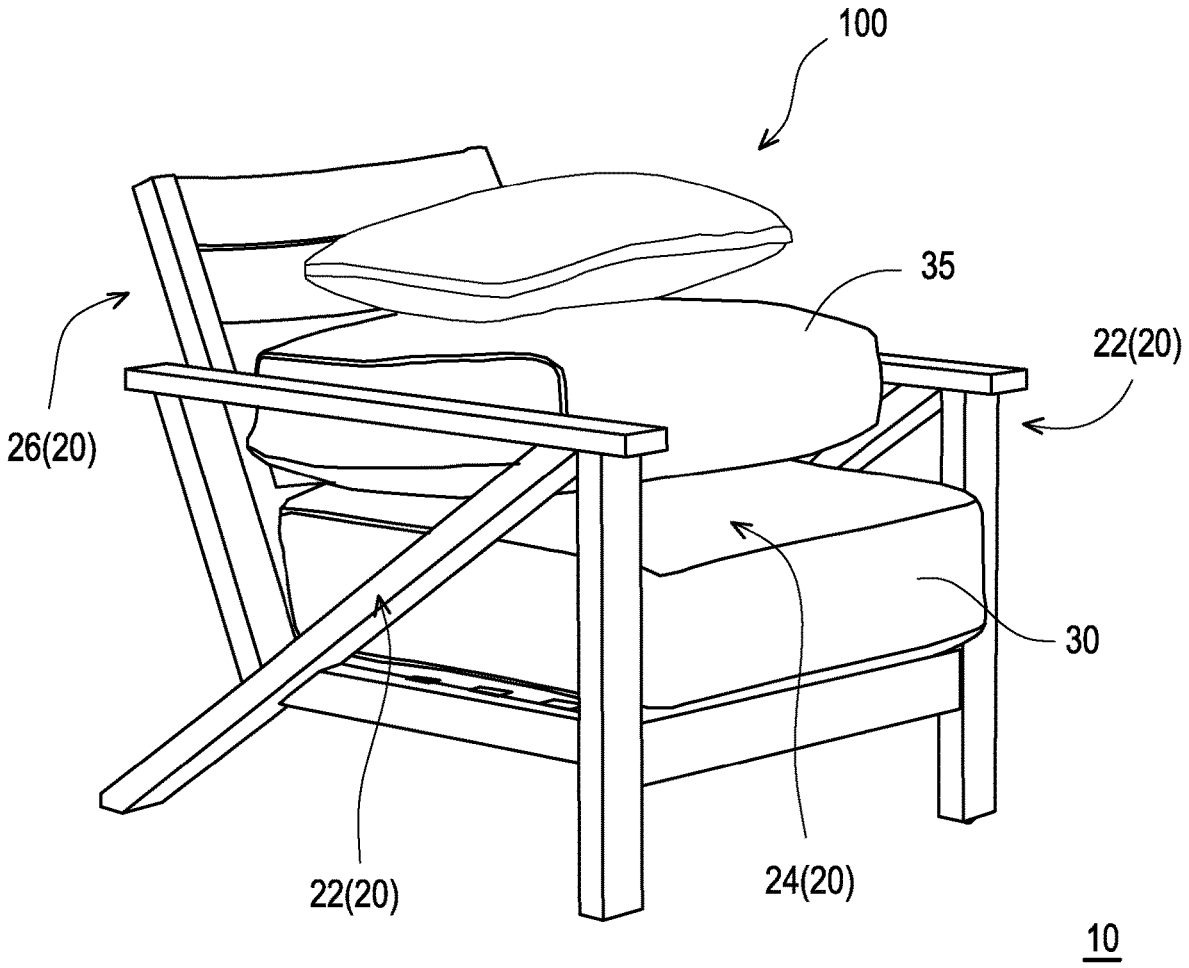
FIG. 2 is a schematic drawing showing the dual use device according to an embodiment of the disclosure in its stored state placed to begin the transition to its protective state.

With reference to FIG. 2, in this embodiment, when the dual use device 100 is to be transformed, the user may first flip the back cushion 35 onto the bottom cushion 30 to provide support for the dual use device 100. In other embodiments, even without the bottom cushion 30 and the back cushion 35 below the dual use device 100, the following operations may still be performed.

Figure 3:
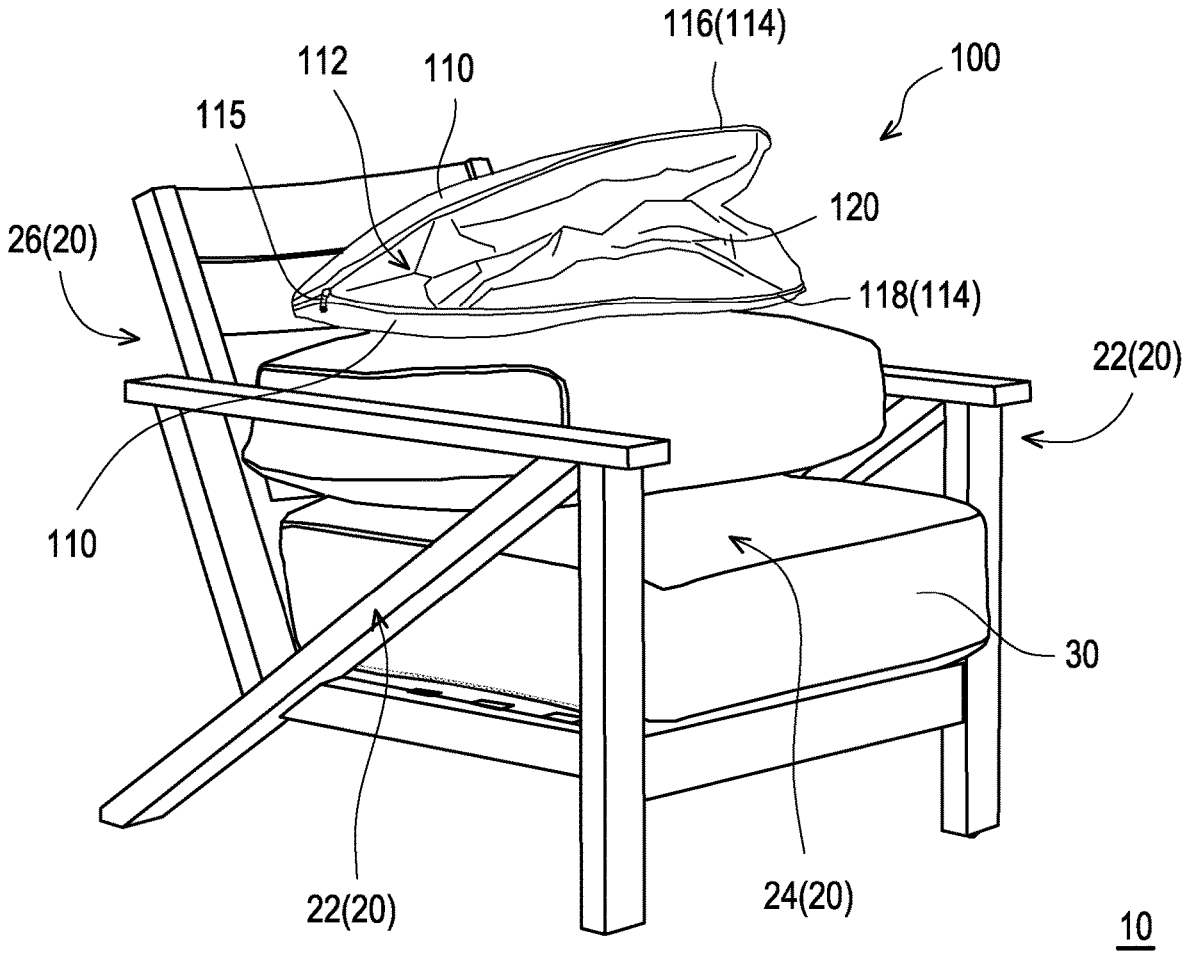
FIG. 3 is a schematic drawing showing the dual use device according to an embodiment of the disclosure with its two connecting elements unsecured.

With reference to FIG. 3, in this embodiment, the dual use device 100 includes two covering elements 110 and a cover body 120. The two covering elements 110 are partially connected and can be selectively closed together or opened. Specifically, in this embodiment, the covering member 110 is in a shape similar to a rectangle, for example, where one of the long sides of the covering member 110 above is connected to one of the long sides of the covering member 110 below, and the remaining three edges (a boundary 114) of the covering member 110 above may be separated from the remaining three edges (the boundary 114) of the covering member 110 below.

When the two covering elements 110 are closed together (i.e., the stored state), an internal space 112 is formed between the two covering elements 110, and the cover body 120 is foldably received in the internal space 112. In other words, when the two covering elements 110 are closed together in the stored state as shown in FIG. 1 and FIG. 2, the two covering elements 110 together serve as an outer shell of the cover body 120. At this time, the entire dual use device may serve as a throw pillow or a bolster pillow.

In this embodiment, the dual use device 100 is exemplified by taking a rectangle as an example. In other embodiments, the dual use device 100 may also be in a shape of a square, a circle, an ellipse, or in other shapes. In addition, the covering member 110 may be a slightly rigid cloth material, or may also be a soft cloth material to improve comfort.

In addition, as can be seen from FIG. 3, in this embodiment, the two covering elements 110 include a first connecting element 116 and a second connecting element 118 located at or near at least a portion of the two boundaries 114 and detachably fixed to each other. When the two covering elements 110 are closed together, the first connecting element 116 is fixed to the second connecting element 118 to maintain a closed state of the two covering elements 110.

Specifically, in this embodiment, the first connecting element 116 and the second connecting element 118 include two zipper strips. The first connecting element 116 and the second connecting element 118 may be fixed together or separated by a slider 115. In other embodiments, the first connecting element 116 and the second connecting element 118 may also include a combination of a button and a buttonhole, a snap and snap clasp, or a hook-and-loop fastener combination. The forms of the first connecting element 116 and the second connecting element 118 are not limited thereto.

In this embodiment, the cover body 120 is fixed to at least one of the two covering elements 110. The cover body 120 may be stitched to a portion of the two covering elements 110 close to the two boundaries 114 when the cover body is unfolded. In other embodiments, the cover body 120 may also be fixed to only one of the covering members 110. The cover body 120 may also be fixed to the covering member 110 through thermocompression bonding or adhering, and is not limited to being stitched. In an embodiment, the cover body 120 may also be separated from the two covering elements 110. In other words, the two covering elements 110 and the cover body 120 are two pieces of structures that are not connected or are removably connected (such as with hook and loop fasteners) together.

Figure 4:
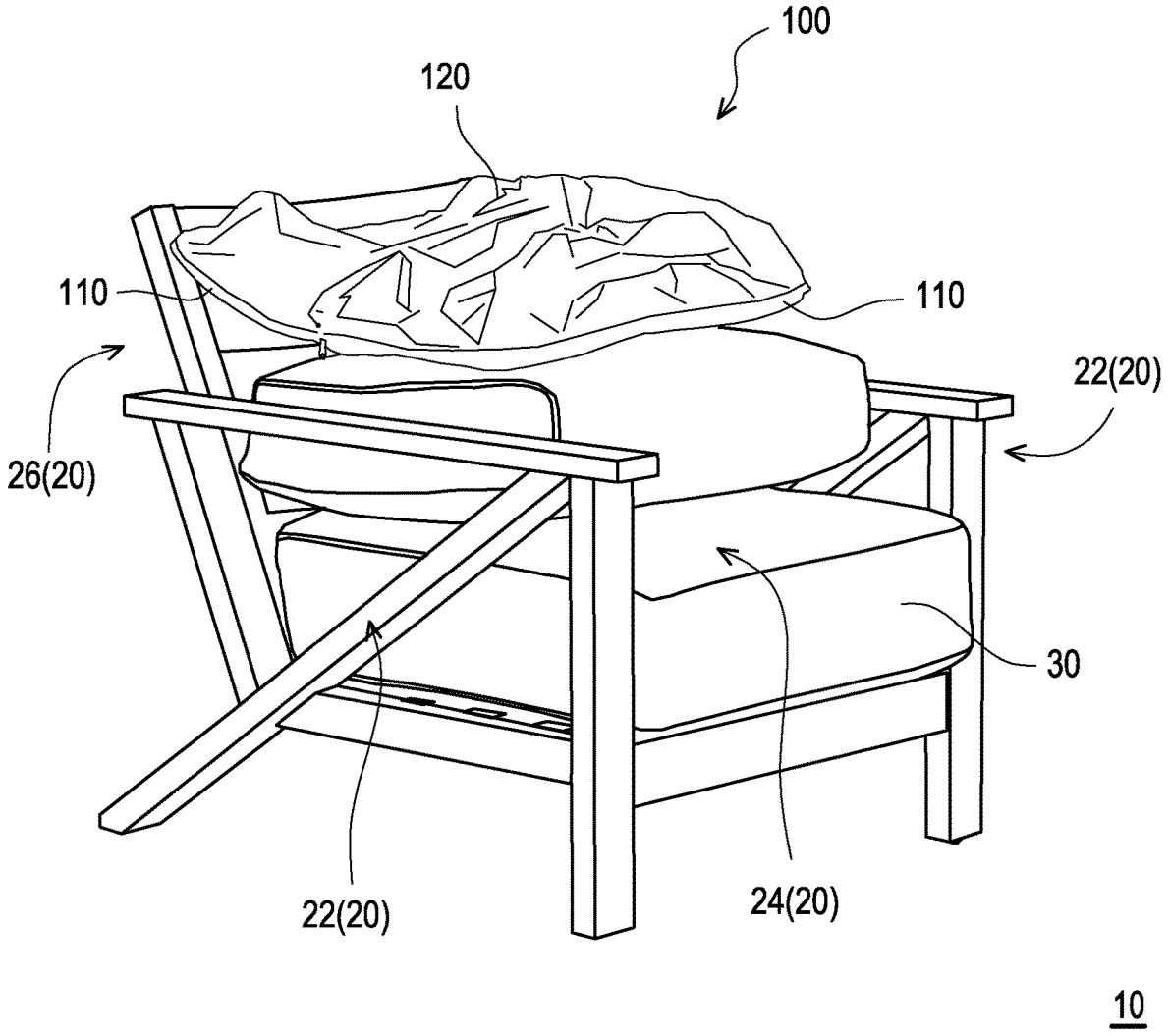
FIG. 4 is a schematic drawing showing the dual use device according to an embodiment of the disclosure with its two covering members completely opened to expose a folded cover body.
Figure 5:
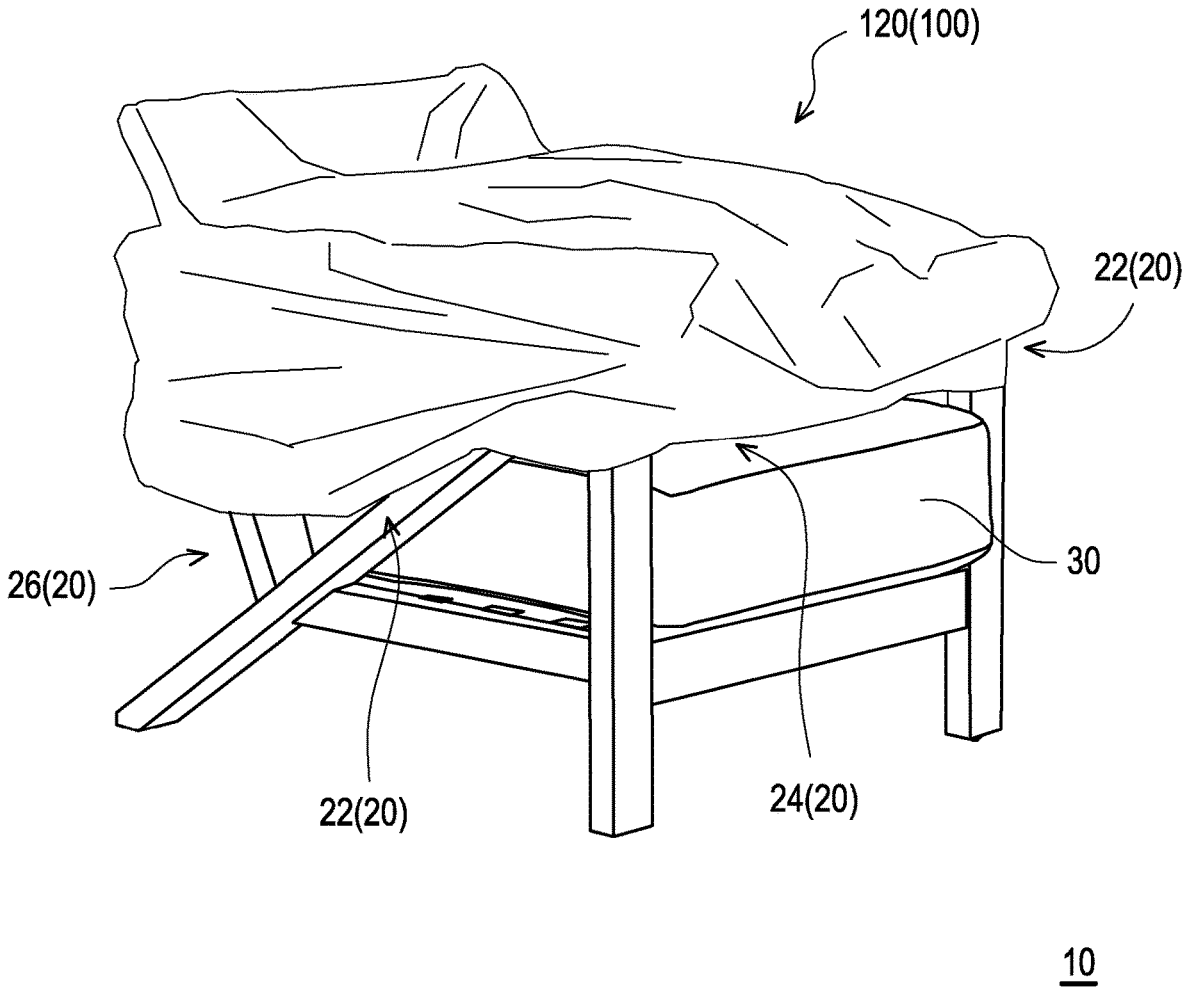
FIG. 5 is a schematic drawing showing the dual use device according to an embodiment of the disclosure the cover body partially unfolded.

With reference to FIG. 4, the two covering elements 110 may be opened to a flattened state. Next, with reference to FIG. 5 and FIG. 6, the cover body 120 originally received between the two covering elements 110 may be gradually unfolded to cover the furniture 20. As can be seen from FIG. 4, the furniture 20 (e.g., a chair) may be divided into two side surfaces 22, a front surface 24 (the front surface 24 here refers to a portion that may be in contact with a back, buttocks, and legs of the user when the user sits on the chair) located between the two side surfaces 22, and a rear surface 26 located between the two side surfaces 22 and behind the furniture 20.

Figure 6:
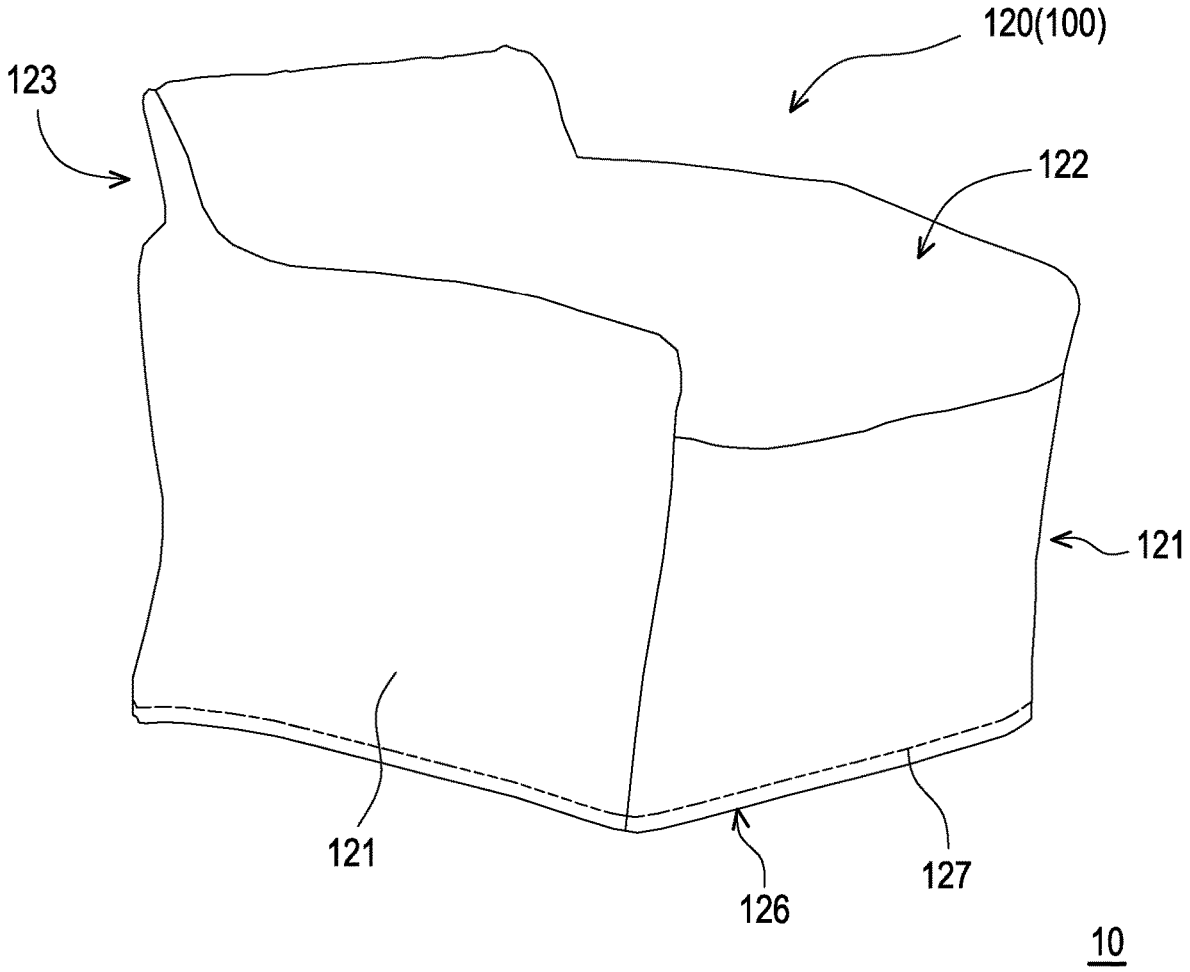
FIG. 6 is a schematic drawing showing the dual use device according to an embodiment of the disclosure with the cover body completed unfolded and covering the furniture.

As shown in FIG. 6, in this embodiment, an outline or shape of the cover body 120 after being unfolded corresponds to an outline or shape of a portion of the furniture 20. The cover body 120 includes two first portions 121, and a second portion 122 and a third portion 123 connected to the two first portions 121. The first portions 121 cover the side surfaces 22 of the furniture 20, the second portion 122 covers the front surface 24 of the furniture 20, and the third portion 123 covers the rear surface 26 of the furniture 20. During manufacturing, the two first portions 121, the second portion 122, and the third portion 123 of the cover body 120 may first be cut out separately, and then be stitched together. As the form and the shape of the furniture 20 differ, the shape and the corresponding portions of the cover body 120 also change accordingly. Also, some of the portions may be formed integral with one another, for examiner portions 122 and 123.

In addition, in this embodiment, since the cover body 120 is covered from the upper side toward the lower side of the furniture 20, the cover body 120 includes an opening 126 located at the bottom of FIG. 6 and a third connecting element 127 close to the opening 126. When the cover body 120 is unfolded and covers the furniture 20, the third connecting element 127 is fixed to the furniture 20 or tightenable to improve the fixation. If the furniture 20 is placed outdoors, the cover body 120 may be well fixed to the furniture 20 by the third connecting element 127 in case of being blown away by strong winds.

In this embodiment, the third connecting element 127 is, for example, an elastic band stitched to the lower edge of the cover body 120. In other embodiments, the third connecting element 127 may also be a binder, an attachment strip, a snap strip, or a hook and loop fastener, and may be fixed or wound around chair legs, table legs, or bed legs of the furniture 20.

In addition, to adapt to the outdoor environment, the cover body 120 may also include a windproof and waterproof material to provide the furniture 20 with relatively great protection. The material of the cover body 120 is not limited thereto as long as the cover body 120 is foldable.

Figure 7:
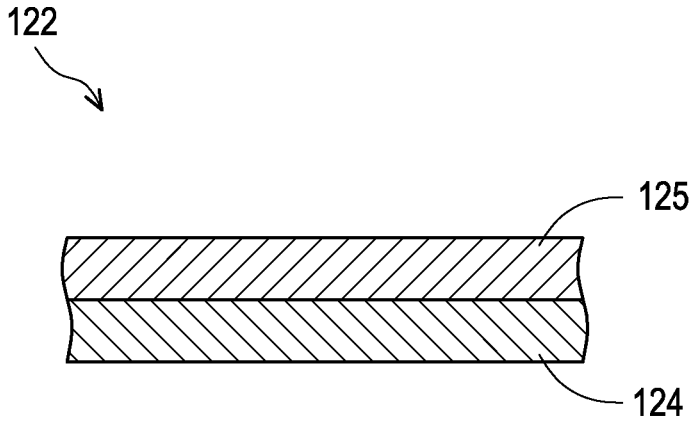
FIG. 7 is a schematic cross-sectional view of the cover body of the dual use device of the furniture module of FIG. 1.

As can be seen from FIG. 6, stitches are not shown in appearance between the second portion 122 of the cover body 120 and the two covering elements 110 (FIG. 4), which is relatively eye-pleasing. FIG. 7 is a schematic cross-sectional view of a portion of the cover body of the dual use device of the furniture module of FIG. 1. With reference to FIG. 7, in this embodiment, at least a part (e.g., the second portion 122) of the cover body 120 includes an inner-layer structure 124 and an outer-layer structure 125. After the cover body 120 is unfolded, the outer-layer structure 125 is located on the outside, i.e., is visible from FIG. 6. The cover body 120 is stitched with the two covering elements 110 preferably through the inner-layer structure 124 of the second portion 122, while the outer-layer structure 125 is not stitched with the two covering elements 110, so that the cover body 120 is relatively eye-pleasing after being unfolded. Also, the inner-layer structure 124 may be made from a soft material, such as cloth or felt, to protect against damage to the furniture, while the outer-layer structure 125 is preferably made from a more durable material less likely to be damaged from exposure to the environment, such as ripstop nylon, weather resistant polymer, and/or fade resistant fabric. If the cover body is to be exposed to water, such as being used outdoors, the outer-layer structure 125 is preferably water resistant or waterproof.

In other embodiments, the two covering elements 110 may also be fixed to the first portion 121 or the third portion 123 of the cover body 120, and is not limited thereto. In addition, in other embodiments, it is also possible that the entire cover body 120 includes the inner-layer structure 124 and the outer-layer structure 125, or the portion connected to the two covering elements 110 includes the inner-layer structure 124 and the outer-layer structure 125, and not limited to the above.

In addition, since the area covered by the second portion 122 of the cover body 120 is relatively large, the second portion 122 may be manufactured with two pieces of material combined. In other embodiments, the second portion 122 of the cover body 120 may be manufactured with a single piece of material if the size of the material is sufficient.

In summary of the foregoing, the dual use device of the furniture module of the disclosure has two use states. When the two covering elements are closed together, the cover body is foldably received in the internal space, and the dual use device may serve as a throw pillow or a bolster pillow. When the two covering elements are opened, the cover body is adapted to be unfolded and cover the furniture, and may serve as a protective cover or a dust cover. In an embodiment, since the cover body is fixed to the covering elements, the cover body may not be separated from the covering elements. If the cover body is not needed by the user to cover the furniture, the cover body may be received directly by the two covering elements without the additional need for looking for a bag. In another embodiment, the cover body may also be separated from the two covering elements, and the cover body may still be received between the two covering elements by the user. In addition, the dual use device after being received may also directly serve as a throw pillow or a bolster pillow and be used with the furniture to improve comfort of the user. If it is needed to cover the furniture, since the dual use device may be directly placed on the furniture, the dual use device may also be obtained directly and quickly without the need for rummaging through containers, and the overall design is convenient.

Figure 8:
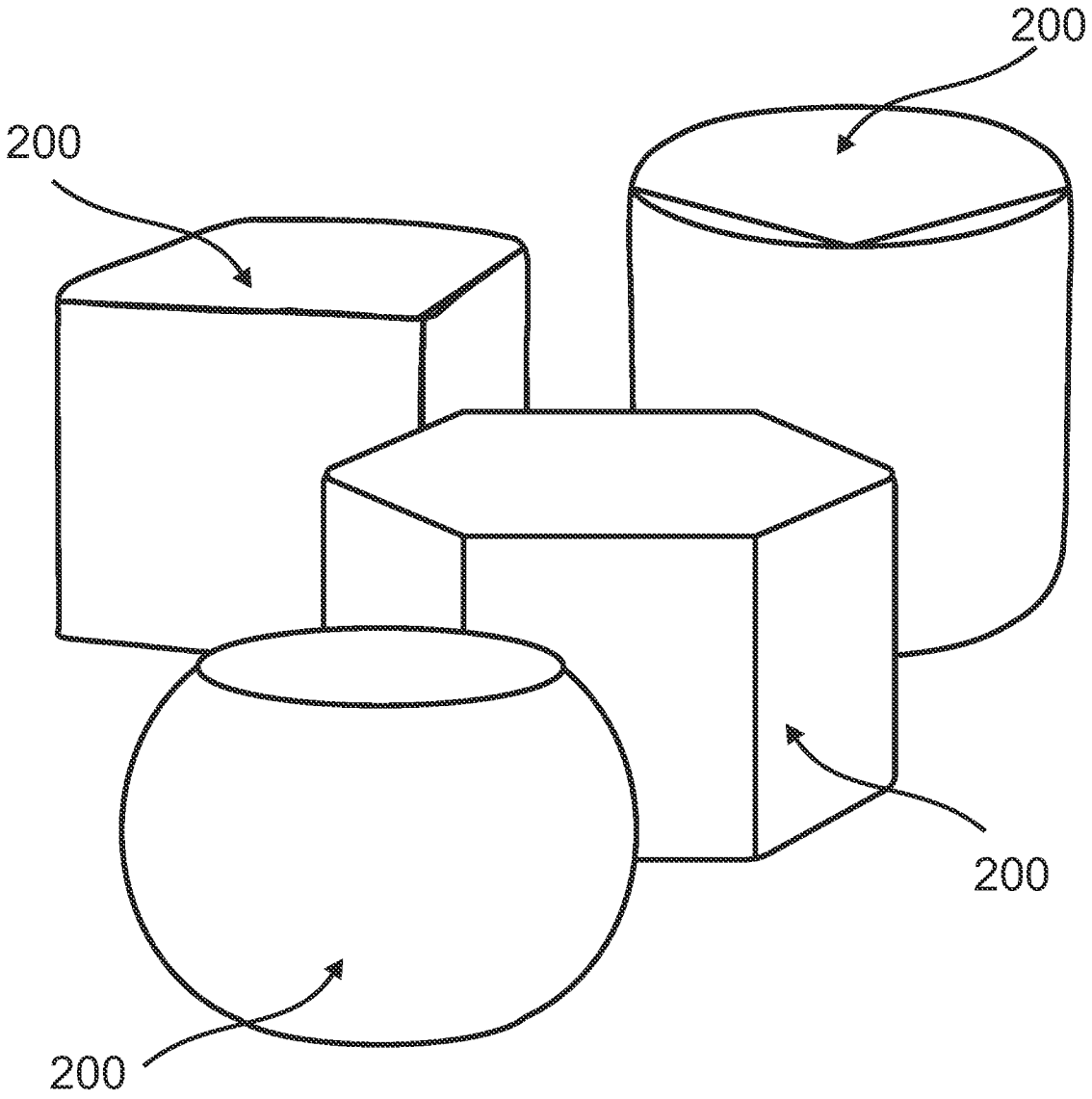
FIG. 8 illustrates schematic embodiments of the dual use device as a furniture component in its stored state.

In another embodiment, the dual use device in its stored (i.e., non-covering) state may be a furniture item or component, such as an ottoman, pouf, footrest, etc. that includes the cover body stored inside. For example, referring to FIG. 8, the dual use device 200 is shown as a furniture component that may be, for example, an ottoman, pouf, footrest, or seat, when the dual use device is in its stored state. It is contemplated that the shape of the furniture component can vary as shown. One preferred configuration of the furniture component as an ottoman or pouf is discussed below, but those skilled in the art would be able to configure the dual use device into other furniture components.

Figure 9:
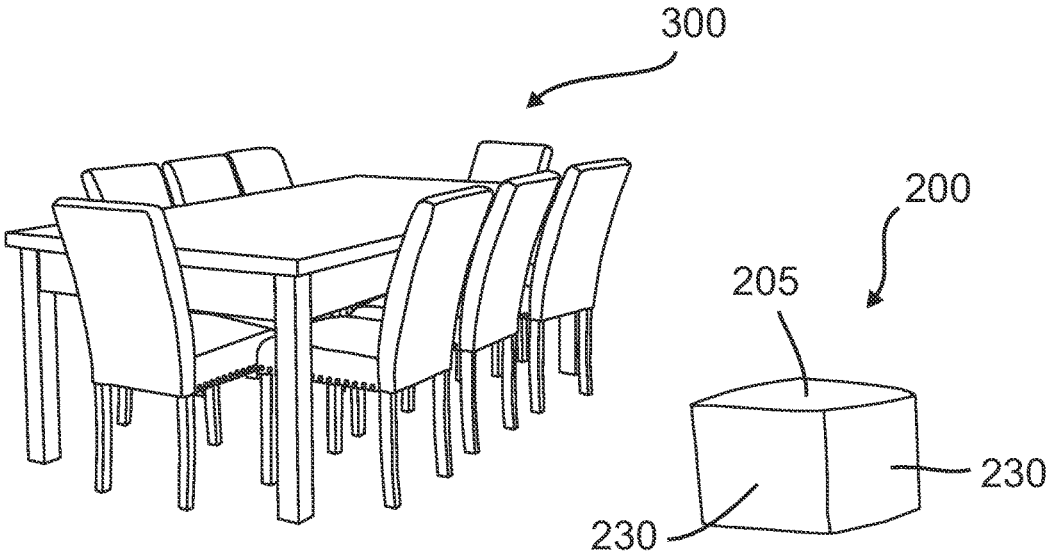
FIG. 9 is a schematic embodiment of one of the dual use devices of FIG. 8 in the form of an ottoman or pouf for use in providing a protective cover for a table set.

Referring the FIG. 9, an ottoman 200 is shown in its normal, stored state. The ottoman 200 includes a top panel 205, at least one sidewall panel 203 and a bottom portion (not shown). In the illustrated embodiment the ottoman is in the shape of a cube, so there are four sidewall panels 230, with adjacent panels removably secured to each other along their common edge by an attachment device 220. Each sidewall panel 230 is attached to the top panel 205 along an upper edge. The ottoman 200 is shown positioned adjacent to a piece or set of furniture 300 that is intended to be covered, such as a table and chairs. While a table and chairs are shown as the furniture to be covered, the present invention can be used to cover other furniture, such as cabinets, dressers, firepits grills, etc.

Figure 10:
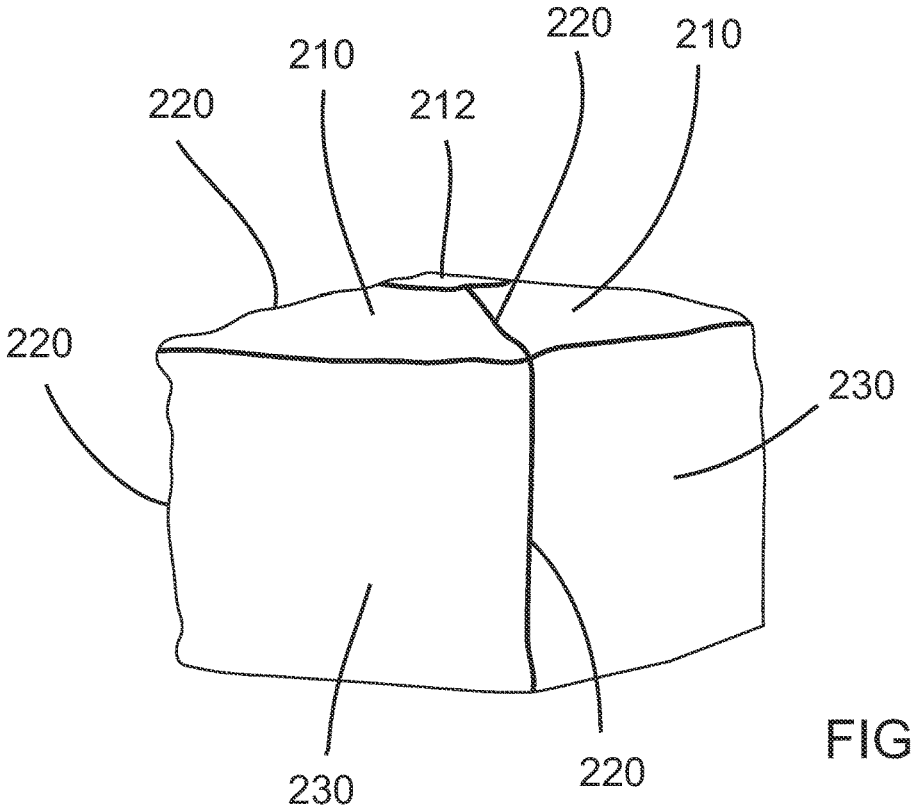
FIG. 10 is an enlarged schematic view of the ottoman of FIG. 9, inverted prior to opening.

The construction of the ottoman is best described through a discussion of the transition of the ottoman from its stored state to its covering state where the internally stored cover is deployed over the furniture. Referring to FIG. 10, the ottoman 200 is turned upside down so that its top panel 305 is now facing downward and the bottom section is facing upwards. The bottom section is preferably formed by four triangular or trapezoidal shaped bottom panels 210, with each bottom panel 210 attached to a bottom edge of the sidewall panel 230. Each bottom panel 210 is removably secured to an adjacent bottom panel 210 along a common edge with an attachment device 220 as will be discussed in more detail. A bottom cover 212 may be provided and is preferably attached to or can be an extension of one of the bottom panels 210 and covers the location where the four bottom panels 210 meet at the center of the bottom section.

In an embodiment, the attachment device 220 of the bottom panels 210 to one another and the sidewall panels 230 to one another is preferably through a common attachment device 220, such as a zipper, that starts at the center of the bottom section and extends along the common edge between the adjacent bottom panels 210 and adjacent sidewall panels 230 to the top panel 205. Thus, four zippers 220 provide the securement of he sidewall panels 230 and the bottom panels 210. In the stored position shown in FIG. 10, the zippers all meet at the center of the bottom section. Since this location would normally be on the floor, to protect the floor from damage the bottom cover 212 preferably covers the zipper pulls.

While zippers are preferably used in the illustrated embodiment, it is also contemplated that the attachment device 220 could be buttons and buttonholes, snaps, hook and loop fasteners or similar well known attachment devices.

Figure 11:
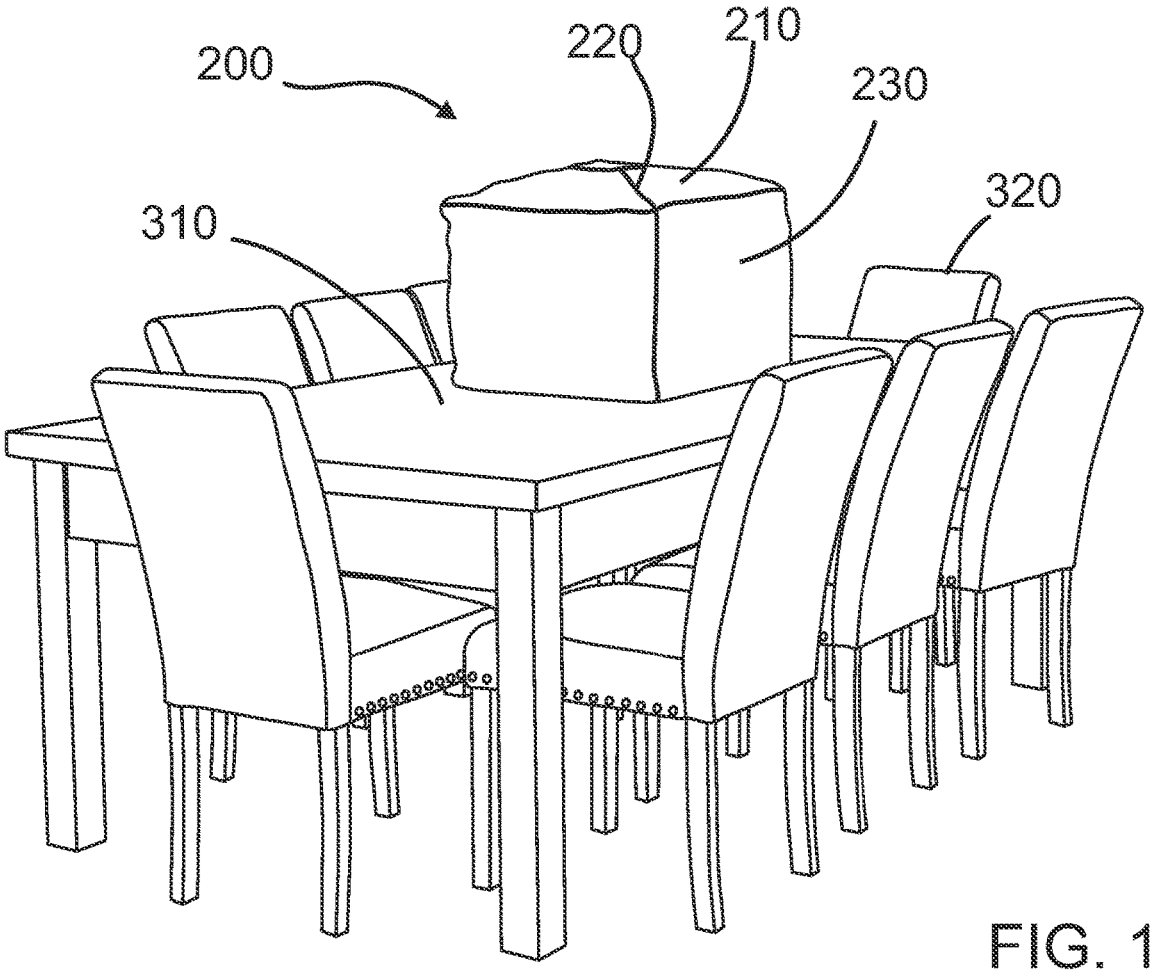
FIG. 11 is a schematic view of the ottoman of FIG. 10 placed on the table prior to opening.
Figure 12:
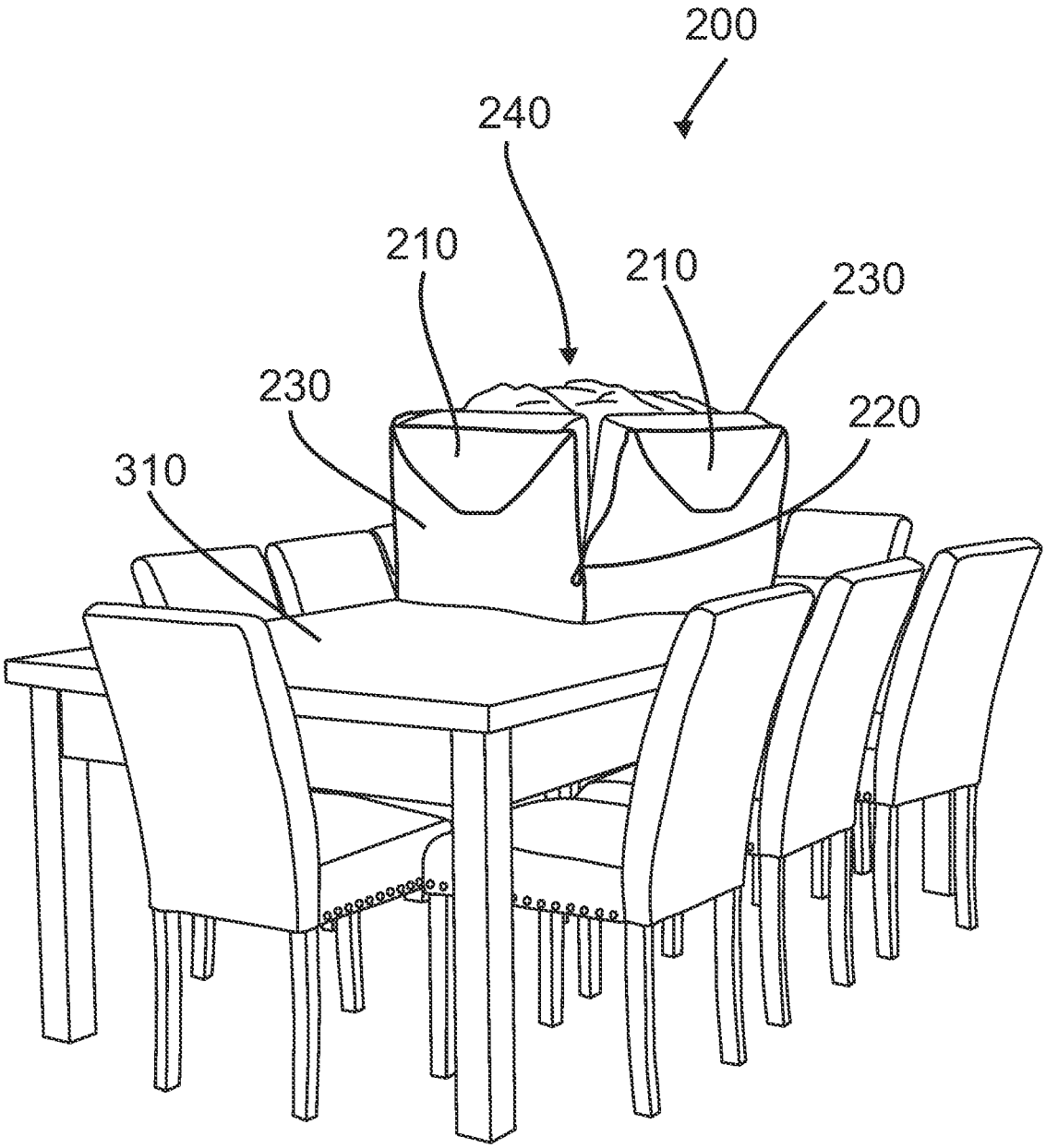
FIG. 12 is a schematic view of the ottoman of FIG. 10 in the process of transitioning from its stored state to its covering state.
Figure 13:
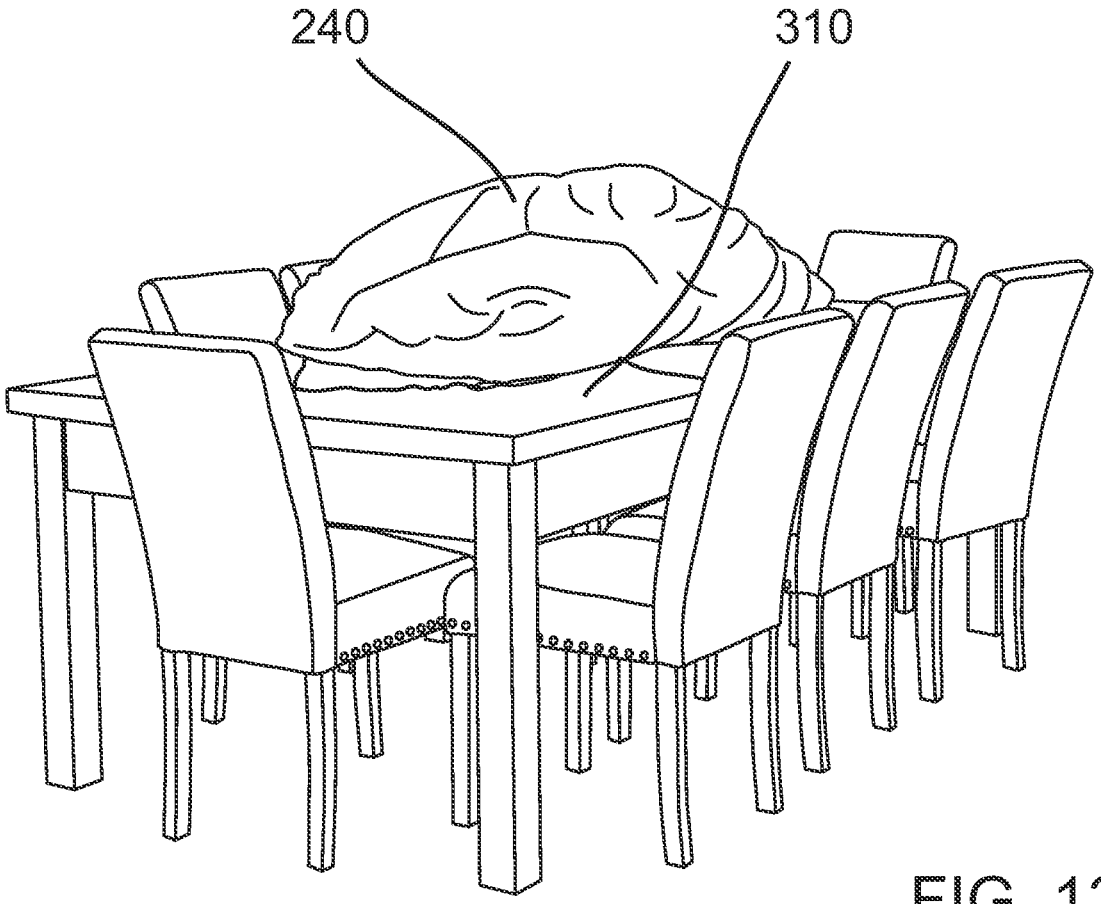
FIG. 13 is a schematic view of the ottoman with the cover removed from its stored position inside the ottoman.
Figure 14:
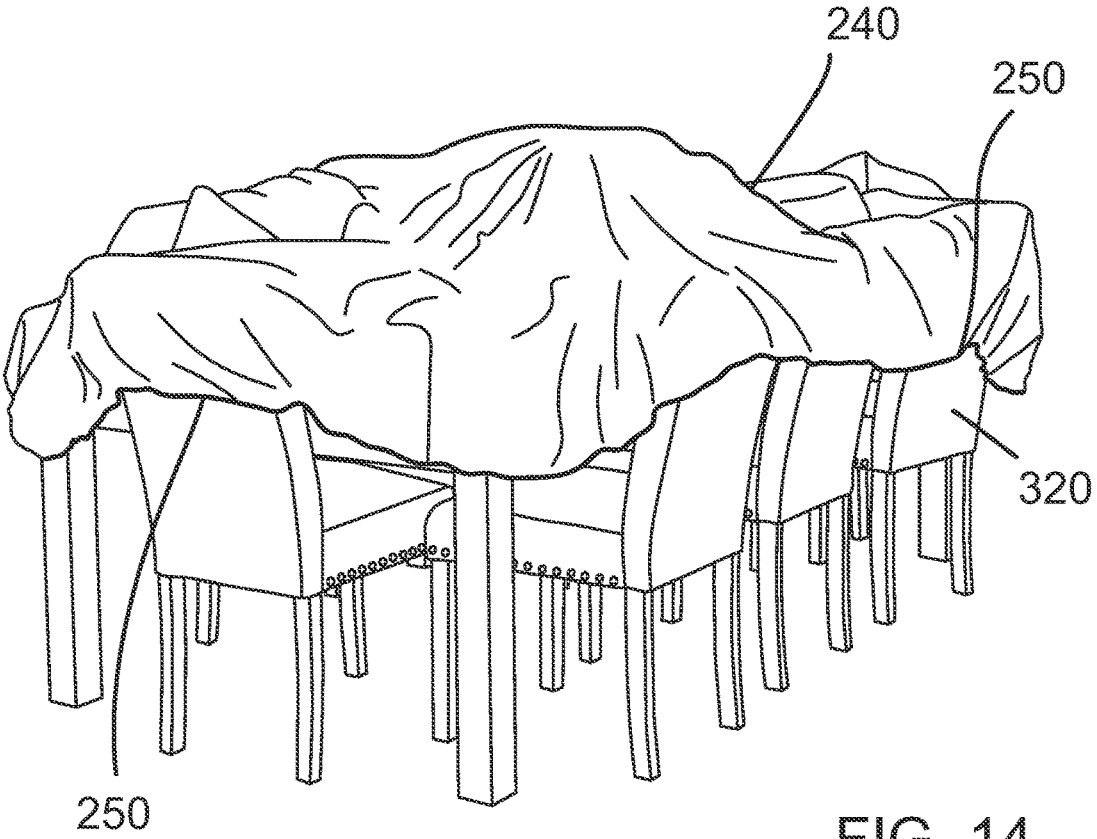
FIG. 14 is a schematic view of the cover partially deployed over the furniture being covered.
Figure 15:
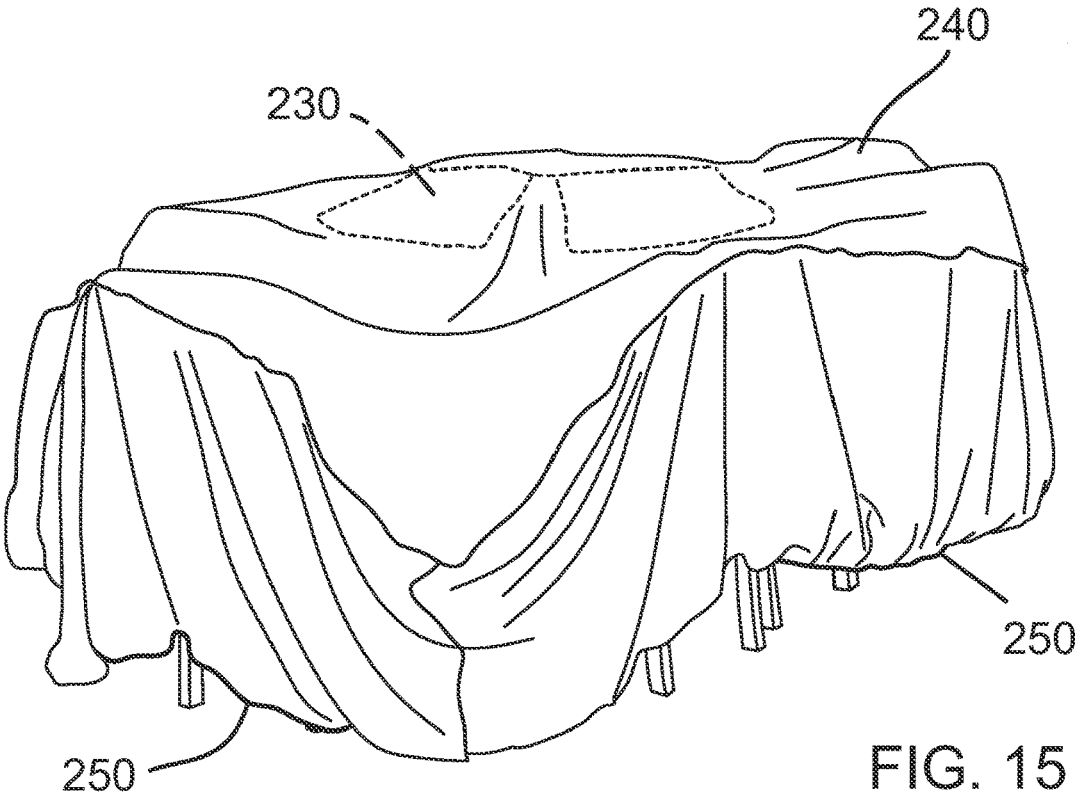
FIG. 15 is a schematic view of the cover completed deployed and covering the furniture.

Referring to FIGS. 11 and 12, the ottoman 200 is placed in its inverted position on the furniture being covered, such as a table 310. Each attachment device 220 is disengaged (e.g., the zipper is unzipped). The bottom panels 210 are preferably flipped onto the sidewall panels 230 as shown exposing the cover 240 that is stored inside the ottoman 200. The sidewall panels 230 are laid flat on the tabletop and the cover 240 is pulled outward as shown in FIGS. 13, 14 and 15. The user pulls the edges 250 of the cover 240 over the furniture edges or corners. In in the illustrated embodiment, the edges 250 of the cover 240 are pulled over the backs of the chairs 320 so as to provide the necessary protection for the furniture. As shown by the dashed lines, the sidewall panels 230 are located below the cover 240.

Figure 16:
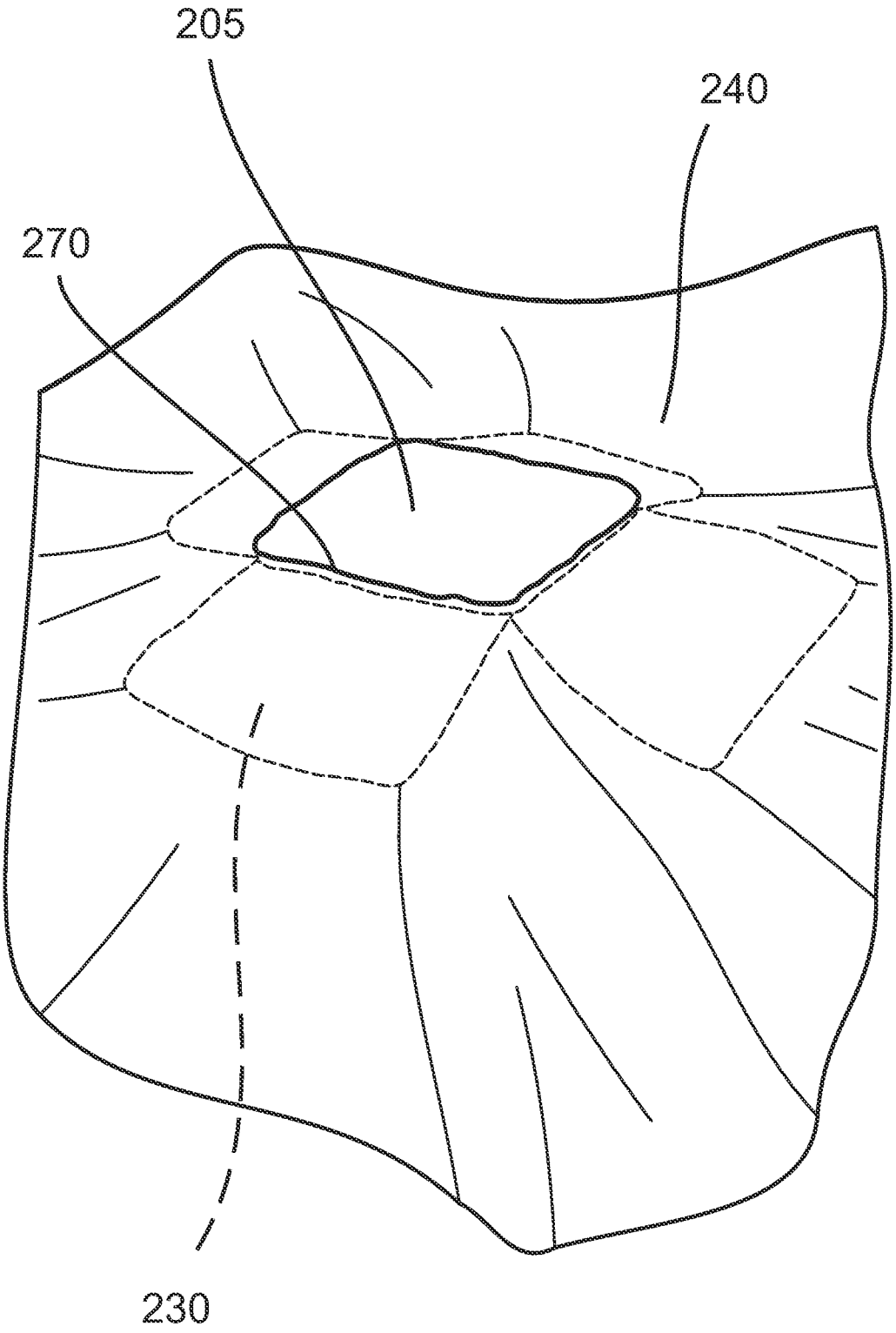
FIG. 16 is an enlarged view of a portion of the cover in its deployed covering state illustrating its attachment to the top panel of the ottoman.

Referring now to FIG. 16, an enlargement of one embodiment of the ottoman is shown in its covering state with the cover 240 deployed. In this embodiment, the bottom side of the top panel 205 is facing upwards (i.e., the top side of the top panel 205 is facing downwards on the tabletop.) The cover 240 may be attached to the edges 270 of the top panel 205 or the cover could be attached to the top panel 205 in any other suitable manner. It is also contemplated that the cover 240 need not be secured to the top panel 205.

Alternatively, in the illustrated embodiment, the cover 240 is a continuous fabric component and the top panel 205 is simply attached directly to the side of the cover 240 that is intended to contact the furniture, i.e., the fabric side or soft material inner-layer structure discussed above) with the outer-layer weather protective structure facing outwards. The top panel 205 can be secured to the cover 240 through any suitable means, including adhesive, hook and loop fasteners, stitching, etc.

Figure 17:
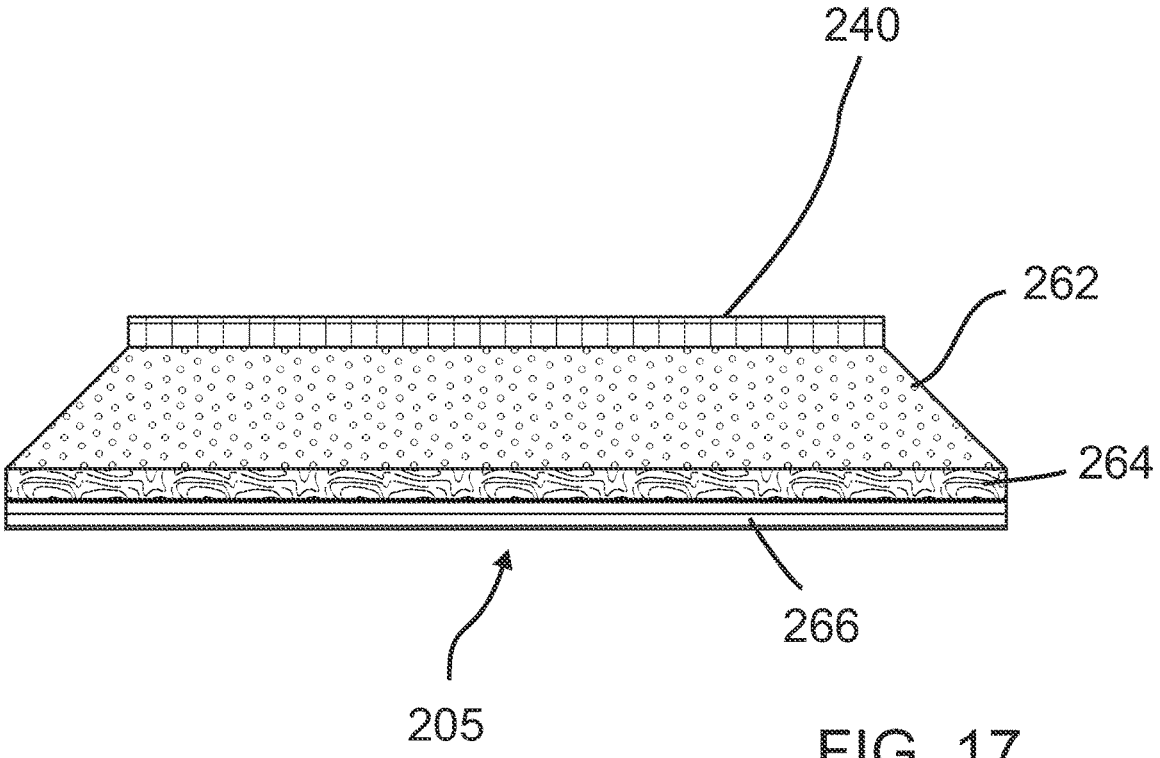
FIG. 17 is a cross sectional view of an embodiment of the top panel.
Figure 18:
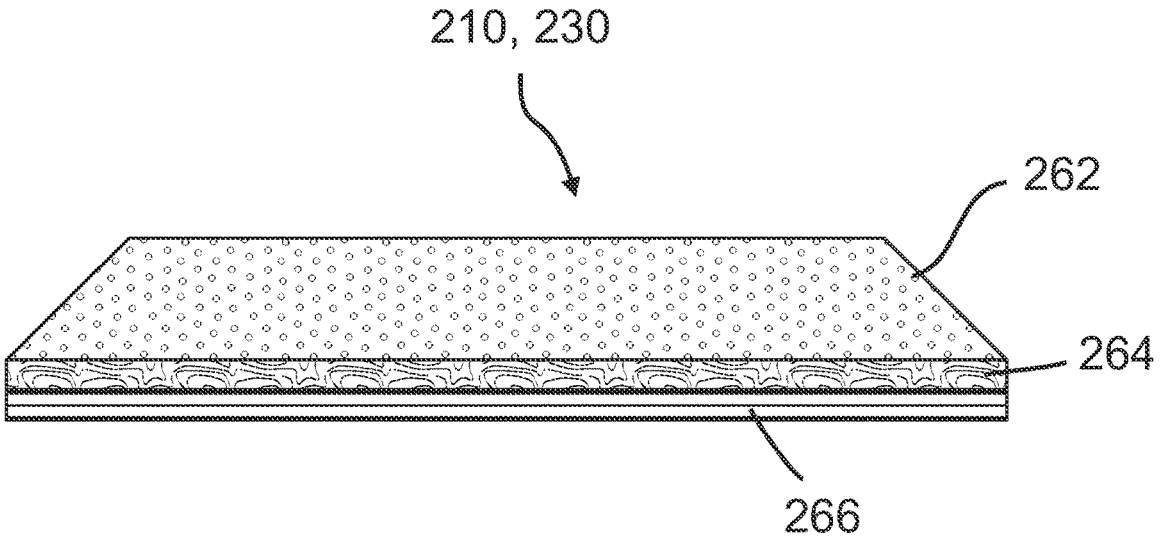
FIG. 18 is a cross sectional view of an embodiment of the sidewall panel.

Referring to FIGS. 17 and 18, cross-sections of embodiments of the top panel 205, and sidewall panel 203 and/or bottom panel 210 are shown. In order to provide shape to the dual use device in its stored state, the top panel 205, sidewall panels 230 and preferably the bottom panels 210 include some structure to provide stiffness and maintain shape. For example, in the illustrated embodiment discussed above where the top panel 205 is attached to the cover 240, the top panel 205 includes an outer surface material 266 that is the outward facing material when the dual use device 200 is in its stored position. The outer surface material 266 is preferably a fabric material, such as cloth, leather, or pseudo leather. A stiffening structure is located between the outer surface material 266 and the cover 240. In the illustrated embodiment, the stiffening structure preferably includes two layers, a filler or cushion layer 264, such as polyester batting, down feathers, or other soft material commonly used in cushions, and a stiffening layer 262, such as high density or low density foam, plastic, wood, cardboard. etc. Any stiffening material commonly used in manufacturing furniture could be used.

Referring to FIG. 18, the sidewall panel 230 is preferably constructed similar to the top panel 205, although the cover 240 is not attached to the sidewall panel in this embodiment. The sidewall panel 230 includes an outer surface material 266 that is the outward facing material when the dual use device 200 is in its stored position. The outer surface material 266 may be the same as or different from the outer surface material 266 of the top panel 205. If the outer surface material is that same as in the top panel, then it is contemplated that the material may be a continuous layer of material that extends from the top panel 205 to the sidewall panel 230, and may extend to the associated bottom panel 210 that is attached to each side panel 230. As with the top panel 205, the sidewall panel 230 preferably includes a stiffening structure that is attached to the outer surface material 266. In the illustrated embodiment, the stiffening structure preferably includes two layers, a filler or cushion layer 264, such as polyester batting, down feathers, or other soft material commonly used in cushions, and a stiffening layer 262, such as high density or low density foam, plastic, wood, cardboard. etc. Any stiffening material commonly used in manufacturing furniture could be used.

As discussed above, the bottom panels 210 may be constructed similar to the sidewall panels 230. Alternatively, the bottom panels 210 could be constructed differently, for example, the outer surface material 266 maybe made of a more durable material, such as nylon, polyester, or a weather resistant polymer since it will be in contact with the ground when the dual use device is in its stored state.

In the above embodiment of the dual use device, the cover 240 may be constructed of materials similar to the cover body 120.

It will be apparent to those skilled in the art that various modifications and variations can be made to the disclosed embodiments without departing from the scope or spirit of the disclosure. In view of the foregoing, it is intended that the disclosure covers modifications and variations provided that they fall within the scope of the following claims and their equivalents.

What is claimed is:

1. A dual use device adapted to be used to cover a furniture item, the dual use device having a stored state and a covering state, the dual use device being in the form of a furniture component in its stored state, the dual use device comprising:

an enclosure including a plurality of enclosure panels, the enclosure panels being connected so as to define a shape of the furniture component, wherein the connection between at least some of the enclosure panels is through one or more detachable attachments which permit the at least some enclosure elements to be separated from one another when the attachment is detached so as to provide an opening into an internal space within the enclosure; and a cover for covering a furniture item, the cover being foldably received within the internal space when the dual use device is in its stored state and the dual use device serves as a furniture component, and the cover adapted to be extracted from the internal space and unfolded to cover the furniture item when the dual use device is in its covering state;

wherein the plurality of enclosure panels comprise a top panel, a plurality of sidewall panels attached to the top panel; and bottom panel attached to each of the sidewall panels; and wherein the detachable connections are between adjacent sidewall panels and between adjacent bottom panels.

2. The dual use device according to claim 1, wherein the cover is fixed to a portion of at least one of the enclosure panels on a surface within the internal space.

3. The dual use device according to claim 1, wherein the furniture component is ottoman, pouf, footrest or seat.

4. The dual use device according to claim 1, wherein the detachable connections are zippers and wherein one zipper extends between adjacent sidewall panels and the corresponding adjacent bottom panels.

5. The dual use device according to claim 1, wherein at least some of the enclosure panels include an outer fabric layer attached to a stiffened structure positioned on an interior side of the enclosure panels, the stiffened structure providing support for the dual use device as a furniture component.

6. The dual use device according to claim 4, wherein the stiffened structure includes a cushion layer and a stiffening layer that is structurally stiffer than the cushion layer.

7. The dual use device according to claim 6, wherein the cushion layer includes at least one of polyester batting or down feathers, and the stiffening layer includes at least one of high density foam, low density foam, plastic, wood, or cardboard.

8. The dual use device according to claim 7, wherein the cushioning layer is attached to an inside surface of the outer fabric layer, and one side of the stiffening layer is attached to the cushioning layer and the other side of the stiffening layer is attached to a surface of the cover.

9. A dual use device, adapted to be used with furniture, and comprising:

two covering elements, partially connected and being selectively closed together or opened, wherein when the two covering elements are closed together, an internal space is formed between the two covering elements; and a cover body, wherein when the two covering elements are closed together, the cover body is foldably received in the internal space, and the dual use device serves as a throw pillow or a bolster pillow, wherein when the two covering elements are opened, the cover body is adapted to be unfolded and cover the furniture, wherein the cover body is fixed to a portion of at least one of the two covering elements, wherein the two covering elements comprise a first connecting element located along at least a portion of a boundary of one of the covering elements, and a second connecting element located along at least a portion of a boundary of the other of the covering elements, the first connecting element and the second connecting element being detachably fixed to each other, and wherein when the two covering elements are closed together, the first connecting element is fixed to the second connecting element to maintain a closed state of the two covering elements, and the cover body is stitched to a portion of the two covering elements close to the two boundaries when the two covering elements are unfolded, wherein the first connecting element and the second connecting element comprise a zipper set, a combination of a button and a buttonhole, or a hook-and-loop fastener combination, and wherein at least a part of the cover body comprises an inner-layer structure and an outer-layer structure, and the inner-layer structure is fixed to the at least one of the two covering elements.

10. The dual use device according to claim 9, wherein the cover body comprises two first portions, and a second portion and a third portion connected to the two first portions, the first portions cover a side surface of the furniture, the second portion covers a front surface of the furniture, the third portion covers a rear surface of the furniture, and the second portion is fixed to the at least one of the two covering elements.

11. The dual use device according to claim 9, wherein the cover body comprises an opening and a third connecting element close to the opening, and when the cover body is unfolded and covers the furniture, the third connecting element is fixable to the furniture.

12. The dual use device according to claim 11, wherein the third connecting element comprises an elastic band, a binder, an attachment strip, a hook and loop fastener, or a snap strip.

13. The dual use device according to claim 9, wherein when the two covering elements are closed together, the dual use device is in a shape of a square, a rectangle, a circle, or an ellipse.

14. A dual use device adapted to be used with a furniture item, the dual use device being a furniture component to be used with or in relation to the furniture item, the furniture component comprising:

an enclosure including a plurality of covering elements, the covering elements being connected to one another so as to define the external surface of the enclosure, an opening formed between at least two of the covering elements, the opening being selectively closed or opened, wherein the opening provides access to an internal space within the enclosure; and a cover body, wherein when the opening is closed, the cover body is foldably received within the internal space, and the dual use device serves as a furniture component, wherein when the opening is opened, the cover body is adapted to be extracted from the internal space and unfolded to cover the furniture item, wherein the cover body is fixed to a portion of at least one of the two covering elements within the internal space, wherein the furniture component is a pillow, a throw pillow or a bolster pillow, wherein the at least two of the covering elements that define the opening include connecting elements for closing the opening, the connecting elements selected from a group consisting of a zipper set, a combination of a button and a buttonhole, and a hook-and-loop fastener combination, and wherein at least a part of the cover body comprises an inner-layer structure and an outer-layer structure, wherein the inner layer structure is configured to come into contact with the furniture item.

* * * * *